US006696210B2

(12) United States Patent
Yaguchi et al.

(10) Patent No.: US 6,696,210 B2
(45) Date of Patent: Feb. 24, 2004

(54) ELECTROSTATIC CHARGE DEVELOPING TONER AND IMAGE FORMING METHOD USING THE SAME

(75) Inventors: Shigenori Yaguchi, Ibaraki (JP); Ryuuichi Shimizu, Ibaraki (JP); Junji Kobayashi, Ibaraki (JP); Tsuneaki Kawanishi, Ibaraki (JP); Nobuyoshi Hoshi, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 26 days.

(21) Appl. No.: 10/092,531

(22) Filed: Mar. 8, 2002

(65) Prior Publication Data

US 2002/0160291 A1 Oct. 31, 2002

(30) Foreign Application Priority Data

Mar. 9, 2001 (JP) ..... P.2001-067332

(51) Int. Cl.[7] ..... G03G 9/08

(52) U.S. Cl. ..... 430/108.1; 430/108.8; 430/110.1

(58) Field of Search ..... 430/108.1, 108.8, 430/110.1

(56) References Cited

U.S. PATENT DOCUMENTS

| | | | | | |
|---|---|---|---|---|---|
| 5,364,722 | A | * | 11/1994 | Tanikawa et al. | 430/108.8 |
| 5,612,160 | A | * | 3/1997 | Inoue et al. | 430/108.8 |
| 2002/0022189 | A1 | * | 2/2002 | Kawanishi et al. | 430/108.8 |

FOREIGN PATENT DOCUMENTS

JP 2000-338717 * 12/2000

OTHER PUBLICATIONS

English translation of JP 2000–338717.*

* cited by examiner

*Primary Examiner*—Mark A. Chapman
(74) *Attorney, Agent, or Firm*—McGinn & Gibb, PLLC

(57) ABSTRACT

Electrostatic charge developing toner contains at least fixing resin, a coloring agent and wax. Wax having number average molecular weight of not higher than 600 is contained as a component of the wax. A volume average particle size of the toner is in a range of from 5 $\mu$m to 10 $\mu$m. Toner particles each having a particle size of not larger than 4 $\mu$m are contained by 10% or lower by number of the total number of toner particles.

18 Claims, No Drawings

ELECTROSTATIC CHARGE DEVELOPING TONER AND IMAGE FORMING METHOD USING THE SAME

BACKGROUND OF THE INVENTION

1. Field of the Invention

The present invention relates to electrostatic charge developing toner for visualizing an electrostatic charge latent image formed in an electrophotographic method, an electrostatic printing method, an electrostatic recording method, or the like, and an image forming method using the electrostatic charge developing toner.

2. Description of the Related Art

Of the recording methods, for example, in the electrophotographic method, a photoconductive photosensitive body is charged and exposed so that an electrostatic charge latent image is formed on the photosensitive body. This electrostatic charge latent image is developed with fine-grained toner containing a coloring agent and so on, while using resin as a binder. The obtained toner image is transferred and fixed onto recording paper to thereby obtain a recorded image. Particularly, in such an electrostatic image recording process, development of an electrostatic charge latent image with fine-grained toner, and fixing of a toner image onto recording paper are important steps.

In the related art, a magnetic brush developing method using a binary developer composed of toner capable of high-speed and high-picture-quality development and magnetic carrier is generally used as a method for developing an image with toner.

In addition, a heat roller fixing method which is high in thermal efficiency and capable of high-speed fixing is often used as a method for fixing the toner.

On the other hand, recently, with the development of information apparatus, laser beam printers have made progress. In such a layer beam printer, a laser beam is used for exposing a photoconductive photosensitive body so as to reproduce every dot for a recorded image by a modulating signal based on instructions from a computer. Particularly, in a recent laser beam printer, the diameter of a laser beam is narrowed down to increase the dot density to 600 to 1,200 dpi (dots/inch) in order to meet the demand for producing an image with a higher picture quality.

With the increase of the dot density, the particle sizes of toner and carrier become smaller to develop a fine electrostatic charge latent image. Thus, application of fine-grained toner having a volume average particle size of not larger than 10 $\mu$m, and application of fine-grained carrier having a weight average particle size of not larger than 100 $\mu$m have been advanced.

On the other hand, heat roller fixing as described above is often used for the fixing. However, from the following points of view, development of high-performance toner which can be fixed with reduced power consumption of a fixing heater and a driving motor and with lower temperature and lower pressure of a heat roller has been desired.

1) To restrain the printer from being deteriorated due to overheating, and to prevent parts in the printer from producing thermal deterioration;
2) To shorten warm-up time from the time when a developing unit is actuated to the time when fixing becomes possible;
3) To prevent a failure in fixing due to heat absorption into recording paper, so as to make it possible to keep picture quality while feeding the paper continuously;

4) To prevent the recording paper from being curled and fired due to overheating; and
5) To reduce a load on the heat roller, and to simplify and miniaturize the structure of the fixing unit.

On the other hand, when the toner is formed into fine particles not larger than 10 $\mu$m in such a manner as described above, there arise problems as follows.

That is, fine-grained toner used in the developing step indeed brings about an image having a high picture quality, but easily causes toner adhesion (fogging) to a non-image area and toner flying. Accordingly, the handing properties in toner shipping or the like are also easily degraded due to the lowering of fluidity. Further, due to the strength of adhesion and the weakness in impact resistance of the fine-grained toner, carrier pollution (carrier spent) with the toner is easily produced so that the life of developer is easily reduced.

In addition, as for fixing, in order to obtain the same fixing strength, more energy is required than in the case where toner larger in particle size is used. Further, the yield in the steps of pulverizing and classifying in manufacturing the toner is reduced so that the cost of the toner increases.

Such a large number of problems are produced in fine-grained toner. It is usually difficult to put toner smaller than 4 $\mu$m into practical use. Therefore, toner classified to have an average particle size from 4 $\mu$m to 10 $\mu$m is used with the fluidity of the toner being enhanced by the improvement of external additives to the toner and the recipe for the external additives.

On the other hand, the weight average particle size of the carrier is set to be not larger than 100 $\mu$m with the reduction in particle size of the toner. Thus, the specific surface area of the carrier is increased to improve the frictional charging property with the toner. However, when the carrier is smaller than 30 $\mu$m, the magnetic force of the carrier is reduced to easily adhere onto an electrostatic charge image holding member due to electrostatic attraction force. Therefore, carrier classified to have an average particle size in a range of from 30 $\mu$m to 100 $\mu$m is used, and the surface of the carrier is coated with resin in accordance with necessity.

As a result of these improvements in the particle size distribution and in the fluidity and the charging property, fine-grained toner and developer have been able to be put into practical use in copying machines, printers, etc.

However, when printing is performed with real apparatus, particularly when printing at a high speed not lower than 10 pages per minute is repeated, the fine-grained toner has its own peculiar problem. The life of developer is reduced easily due to carrier spent by the toner, and the life of a photosensitive body is reduced easily due to filming of the photosensitive body with the toner.

In addition, it is difficult to obtain fixing strength of an image. Particularly in the fixing step, it is necessary to increase the temperature and pressure of a heat roller. Therefore, there has been a problem that it is difficult to make a fixing unit reliable, simple, small in size and low in cost.

In order to improve the fixing performance of toner, it has been known to add wax to fixing resin. For example, such techniques are disclosed in Japanese Patent Laid-Open No. 3304/1977, No. 3305/1977 and No. 52574/1982.

Such waxes are added to prevent toner from adhering to a heat roller at a low temperature or at a high temperature, that is, to prevent a so-called offset phenomenon.

For example, Japanese Patent Laid-Open No. 313413/1993 discloses that ethylene- or propylene-$\alpha$-olefin copolymer having viscosity of not higher than 10,000 poises at 140° C. is added to vinyl-based copolymer having a particular molecular weight distribution in order to improve the low-temperature fixing property, the offset resistance and the non-aggregability of toner.

In addition, for the similar purpose, Japanese Patent Laid-Open No. 287413/1995 discloses that paraffin wax showing a peak (melting point) at 75° C. to 85° C. in the amount of heat absorption measured by a differential scanning calorimeter (DSC) is added, and Japanese Patent Laid-Open No. 314181/1996, No. 179335/1997 and No. 319139/1997 disclose that natural-gas-based Fischer-Tropsch wax having a melting point in a range of from 85° C. to 100° C. measured by a DSC is added.

In addition, Japanese Patent Laid-Open No. 324513/1994 discloses that polyethylene wax having a melting point in a range of from 85° C. to 110° C. measured by a DSC is added, and Japanese Patent Laid-Open No. 36218/1995 discloses that polyethylene-based wax, in which any component having a melting point not higher than 50° C. has been eliminated by a distillation method or the like so as to make the melting point of the polyethylene-based wax be set in a range of from 70° C. to 120° C. measured by a DSC, is added.

Furthermore, Japanese Patent Laid-Open No. 114942/1996 discloses that polyethylene wax having weight average molecular weight (Mw) lower than 1,000 is added.

On the other hand, when low-melting-point wax is added to toner, the toner deteriorates in fluidity, heat resistance, durability and storage stability.

In order to improve those properties, Japanese Patent Laid-Open No. 123994/1994 discloses that wax not higher than 1.5 in the ratio of weight average molecular weight to number average molecular weight (Mw/Mn) is used; Japanese Patent Laid-Open No.209909/1995 discloses that ethylene-based olefin copolymer wax having melting viscosity in a range of from 0.5 mPa·s to 10 mPa·s at 140° C. and rate of penetration not higher than 3.0 dmm is used; and Japanese Patent Laid-Open No. 287418/1995 discloses that Fischer-Tropsch wax having average molecular weight of not lower than 1,000 is used.

Although the fixing performance of toner may be improved using such related-art techniques, toner improved in fixing performance at lower temperature is demanded from the point of view of increasing speed of printing apparatus or reducing energy consumption. Further, toner having higher durability is demanded to reduce the running cost and to reduce the number of times of maintenance.

SUMMARY OF THE INVENTION

An object of the invention is to provide toner in which energy required for fixing is small; temperature and pressure of a heat roller can be reduced when a heat roller fixing method is adopted; an offset phenomenon is hardly produced; fluidity, heat resistance, durability and storage stability of the toner are excellent; the life of developer is hardly reduced due to carrier spent by the toner; and the life of a photosensitive body is hardly reduced due to filming of the photosensitive body with the toner.

In addition, another object of the invention is to provide a method for forming a stable electrostatic toner image using such toner.

As a result of diligent researches made by the inventors, the invention to attain the foregoing objects was obtained, and it will be summarized next.

[1] Electrostatic charge developing toner contains at least fixing resin, a coloring agent and wax, wherein: wax having number average molecular weight of not higher than 600 is contained as a component of the wax; a volume average particle size of the toner is in a range of from 5 μm to 10 μm; and toner particles each having a particle size of not larger than 4 μm are contained by 10% or lower by number of the total number of toner particles.

[2] An image forming method includes the steps of: developing an electrostatic charge latent image formed on an electrostatic charge holding member by use of a binary developer composed of toner and carrier; transferring the developed toner image onto a recording medium; cleaning up a residual toner image on the electrostatic charge holding member; and fixing the toner image transferred on the recording medium so as to obtain a recorded image; wherein the electrostatic charge developing toner is used in an electrostatic image recording process.

Thus, it is possible to obtain a stable electrostatic toner image which can be fixed at lower temperature than that in the related art.

Incidentally, it is preferable that the maximum value of endothermic peaks on a heat absorption curve during heating in DSC curves of the electrostatic charge developing toner measured by a differential scanning calorimeter is in a range of from 35° C. to 120° C.

DETAILED DESCRIPTION OF THE PRESENT INVENTION

The present invention will be described in detail.

Wax having number average molecular weight of not higher than 600 is an essential component in the invention. Such wax is easy to melt at lower temperature than that in the related art. Thus, when toner contains the wax, the toner melts easily with a smaller quantity of heat. When a heat roller fixing system is adopted, the toner easily permeates a recording medium such as paper with a smaller quantity of heat. The toner is solidified to show an anchor effect. Thus, it is easy to obtain strength against peeling.

Particularly, because the wax contained in the toner exudes to the toner surface, there is also an effect against rubbing, meaning that the lubricant effect of the wax prevents pollution from bringing to the partner paper even if a toner image and the paper rub each other.

As a result of various investigations to prevent such pollution due to rubbing, it was found that low molecular weight wax was effective, and particularly it was very effective to add wax having number average molecular weight of not higher than 600 when the wax was converted into molecular weight on polyethylene basis.

Such an effect against rubbing appears conspicuously when printing is performed with a lot of sheets of printed material put on top of one another, or when the toner is used in image reading apparatus or the like equipped with an automatic paper feeding mechanism. For example, the effect appears conspicuously when printing is performed on cardboard for tickets or name cards.

On the contrary, when wax having number average molecular weight larger than 600 is used, the toner becomes difficult to melt at lower temperature, and further the effect to improve the strength against rubbing is small. This reason is presumed as follows. That is, low molecular weight wax is easy to migrate to the toner surface when the wax is heated. However, the higher the molecular weight of wax is, the more difficult the wax is to migrate to the toner surface. Thus, the surface actualization ratio of the wax actualized on the toner surface after fixing becomes low.

On the other hand, wax having number average molecular weight of not higher than 600 is easily softened. In addition, the wax is soft so that the toner deteriorates in fluidity, heat resistance, durability and storage stability if the wax is added to the toner. Thus, there is a problem that the toner is easily fusion-bonded.

Toner has a tendency as follows. That is, the lower the number average molecular weight of wax is, the worse the fluidity of the toner is. Further, the smaller the particle size of the toner is, the worse the fluidity of the toner is.

Therefore, as a result of investigation into these facts, it was found that the deterioration of fluidity peculiar to wax having number average molecular weight of not higher than 600 could be prevented when the ratio of 4 μm or less particles contained in toner was limited to 10% or lower by number. Further, it was found that the durability was also improved when the ratio of 4 μm or less particles was limited to 10% or lower by number.

In a binary developer, several percents of toner are mixed into magnetic particles called carrier so that the toner is charged by the friction between the carrier and the toner. However, toner not larger than 4 μm is difficult to separate from the carrier so that the toner is in contact with the carrier for a long time. Thus, the toner is apt to cause so-called spent which means that the toner is fusion-bonded with the carrier surface.

The carrier subjected to such spent cannot be charged to a predetermined degree even if new toner comes into contact with the carrier and rubs the carrier. Thus, the quantity of charge is reduced so that the life as a developer is shortened. In addition, fine-grained toner not larger than 4 μm causes toner adhesion (fogging) to a non-image portion and requires more heat energy than toner having a larger particle size when the toner is fixed. Thus, such fine-grained toner is also disadvantageous in low-temperature fixing property.

Accordingly, it will go better if the ratio of fine-grained toner not larger than 4 μm in whole toner is lower. It is preferable that the ratio is not higher than 10% by number of whole toner particles. It is more preferable that the ratio is not higher than 8% by number of whole toner particles. When the ratio of fine-grained toner not larger than 4 μm in whole toner exceeds 10% by number, the toner cannot satisfy fluidity, heat resistance, durability or storage stability as described above.

In addition, it is preferable that the maximum value of endothermic peaks on a heat absorption curve during heating in DSC curves of the toner measured by a differential scanning calorimeter is in a range of from 35° C. to 120° C. It is not preferable that the maximum value of peaks of the toner is lower than 35° C., resulting in a phenomenon that the toner is aggregated during its storage.

On the other hand, the fact that the maximum value of endothermic peaks of the toner exceeds 120° C. means that a component having an endothermic peak exceeding 120° C. is contained in the toner at least in a certain ratio to components having endothermic peaks in a range of from 35° C. to 120° C. This means that the object of the invention to improve the low-temperature fixing property cannot be achieved. It is therefore desired that the maximum value of endothermic peaks is in a range of from 35° C. to 120° C.

In the invention, a large number of waxes may be used appropriately in accordance with their functions. As such waxes, natural waxes and synthetic waxes are available, and waxes converted into number average molecular weight of not higher than 600 on polyethylene basis are available. Examples of the waxes include some kinds of polyethylene waxes, some kinds of paraffin waxes, and some kinds of Fischer-Tropsch waxes, but the invention is not limited to these kinds of waxes.

The content of the wax is used in a range of from 0.1 parts to 10 parts by weight against 100 parts by weight of fixing resin. The wax may be used together with one or more kinds of other waxes.

The molecular weight distribution of the wax in the invention is measured by gel permeation chromatography (GPC) at high temperature in the following conditions.

GPC Measuring Conditions

Apparatus: ALC/GPC 150-C (made by Waters Corp.)
Isolation Column: GMH-HT 60 cm×1 and GMH-HTL 60 cm×1 (made by TOSOH Corp.)
Column Temperature: 135° C.
Mobile Phase: o-dichlorobenzene
Detector: differential refractometer
Flow Rate: 1.0 mL/min
Specimen Density: 0.15 wt %
Injection Rate: 400 μL Measuring is made in such conditions. Molecular weight of a specimen is calculated and converted on a polyethylene basis by use of the Mark-Houwink-Sakurada equation or a conversion equation derived from a viscosity equation, using a molecular weight calibration curve obtained from a monodispersed polystyrene standard specimen.

In addition, in DSC measurement of wax, wax measured about 5 mg is mounted on a DSC, and nitrogen gas is blown at the rate of 500 mL per minute, while the temperature is increased from 20° C. to 150° C. at the rate of 10° C. per minute. Next, the wax is quenched from 150° C. to 20° C. so that its previous history is removed. Then, the temperature is increased at the rate of 10° C. per minute, and peaks of a DSC heat absorption curve at that time are obtained.

The particle size of toner may be measured in various methods. However, in this embodiment, the particle size was measured with a Coulter counter.

Number distribution and volume distribution were measured using 100 μm apertures and a Coulter counter TA-II model (made by Coulter Corp.) as a measuring device. At that time, 50,000 measuring specimens were measured. The measuring specimens were prepared in such a manner that toner to be measured was added to an electrolytic solution with a surface active agent, and dispersed for one minute by an ultrasonic dispersing device.

For example, the following resins can be listed as fixing resin available for the toner according to the invention.

Examples of resins include monopolymers of styrene and substitution products thereof, such as polystyrene, poly(p-chlorostyrene) and polyvinyltoluene; styrene-based copolymers such as styrene-p-chlorostyrene copolymer, styrene-vinyltoluene copolymer, styrene-vinylnaphthalene copolymer, styrene-acrylic ester copolymer, styrene-methacrylate ester copolymer, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; further, poly vinyl chloride, phenolic resin, natural modified phenolic resin, natural resin modified maleic acid resin, acrylic resin, methacrylic resin, polyvinyl acetate, silicon resin, polyester resin, polyurethane, polyamide resin, furan resin, epoxy resin, xylene resin, polyvinyl butyral, terpene resin, chroman-indene resin, and petroleum-based resin. Of them, styrene-based copolymer or polyester resin is preferred.

In addition, low hygroscopic resin obtained by graft copolymerization of styrene-acryl onto polyester resin may be used. Incidentally, styrene-based polymer or styrene-based copolymer may be cross-linked, or may be a mixed resin.

In addition, in the whole or a part of the synthesizing process where fixing resin is synthesized, the fixing resin may be produced in a coexistent polymerization method in which wax is made coexistent with the fixing resin, in order to improve the compatibility between the fixing resin and the wax.

In the method in which fixing resin is produced under the existence of wax in the coexistent polymerization method, styrene-based monomer and/or (meth) acrylic ester monomer are included as constitutive units for vinyl-based copolymer, and other vinyl-based monomers may be included.

Since the coexistent polymerization in which wax is made coexistent is performed in the whole or a part of the process in the invention, it is possible to obtain vinyl-based copolymer in which the wax is dispersed uniformly. Incidentally, the vinyl-based copolymer may be partially cross-linked by a cross-linker chiefly composed of monomer having at least two polymerizable double bonds, such as divinyl benzene, divinyl naphthalene, ethylene glycol methacrylate, 1,3-butanediol dimethacrylate, divinyl aniline, divinyl ether, divinyl sulfide, or divinyl sulfone.

Specific examples of styrene-based monomer as a constitutive unit for vinyl polymer include or thomethyl styrene, methamethyl styrene, alpha-methyl styrene, and 2,4-dimethyl styrene, as well as styrene.

Specific examples of acrylic ester-based or methacrylate ester-based monomer as a constitutive unit for vinyl polymer include acrylic or methacrylate alkyl esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, and stearyl methacrylate.

Further examples include 2-chloroethyl acrylate, phenyl acrylate, α-chloromethyl acrylate, phenyl methacrylate, dimethylaminoethyl methacrylate, diethylaminoethyl methacrylate, 2-hydroxyethyl methacrylate, glycidyl methacrylate, bisglycidyl methacrylate, polyethylene glycol dimethacrylate, and methacryloxy ethyl phosphate.

Particularly, of them, ethyl acrylate, propyl acrylate, butyl acrylate, methyl methacrylate, ethyl methacrylate, propyl methacrylate, and butyl methacrylate are preferably used.

Examples of other vinyl-based monomers as constitutive units for vinyl polymer include acrylic acids such as acrylic acid, methacrylic acid, α-ethyl acrylic acid and crotonic acid, and their α- or β-alkyl derivatives; unsaturated dicarboxylic acids such as fumaric acid, maleic acid, citraconic acid and itaconic acid, and their mono-ester derivatives or diester derivatives; succinic monoacryloyl oxyethyl ester, succinic monomethacryloyl oxyethyl ester, acrylonitrile, methacrylonitrile, and acrylamide.

When a charge control agent is compounded (internally added) or mixed (externally added) to toner particles in the toner according to the invention, the charge quantity of the toner can be controlled to a predetermined value.

Examples of positive charge control agents for the toner include nigrosine; modified products based on metal salts of fatty acids; quaternary-ammonium-salts such as tributylbenzylammonium-1-hydroxy-4-naphthosulfonic acid or tetrabutylammonium tetrafluoroborate, onium salts analogous to the quaternary-ammonium-salts such as phosphonium salts, and lake pigments of these; triphenylmethane dyes, and lake pigments of these; metal salts of higher fatty acids; diorgano tin oxides such as dibutyl tin oxide, dioctyl tin oxide, and dicyclohexyl tin oxide; and diorgano tin borates such as dibutyl tin borate, dioctyl tin borate, and dicyclohexyl tin borate. One or more kinds of such charge control agents may be used.

Of these members, particularly, charge control agents of nigrosine, quaternary-ammonium-salts, and triphenylmethane dyes are preferably used.

Organic metal complexes or chelate compounds are effective as negative charge control agents for the toner. Examples of the organic metal complexes include monoazo metal complexes, acetylacetone metal complexes, and aromatic hydroxyl carboxylic acid based or aromatic dicarboxylic acid based metal complexes.

As other examples, there are aromatic hydroxyl carboxylic acids, aromatic mono- and poly-carboxylic acids, and their metal salts, anhydrides, esters, and phenolic derivatives such as bisphenol.

When such a charge control agent is internally added to toner, it is preferable to add it at the ratio of 0.1 to 10 wt % to fixing resin.

In the toner according to the invention, it is preferable that silica impalpable powder or the like is externally added to improve developing property, fluidity, charge stability, and durability.

Preferably, the silica impalpable powder or the like used in the invention has a specific surface area not smaller than 30 $m^2/g$ measured by nitrogen adsorption following the BET method, and it is externally added at the ratio of 0.01 to 5 wt % to the toner.

In addition, the silica impalpable powder is used while the powder is made hydrophobic or is controlled electrostatically by using various treatments such as organic silicon compounds or other treatments in accordance with necessity. The kind of treatment is selected in accordance with purposes because fluidity, durability, storage stability, and so on, change in accordance with the kind of treatment and the particle size of the silica impalpable powder.

Further, lubricant powder such as Teflon resin powder, zinc stearate powder, or polyvinylidene fluoride powder is used. Particularly, of them, polyvinylidene fluoride powder is preferred. Powder abrasive of cerium oxide, silicon carbide, or strontium titanate is used. Of them, strontium titanate power is preferred. In addition, a fluidity enhancer such as titanium oxide or aluminum oxide is used. Particularly, of them, a hydrophobic member is preferred.

An anti-aggregation agent, an electric conductivity enhancer such as carbon black, zinc oxide, antimony oxide or tin oxide, and a developing property improver composed of antipolar white fine particles and antipolar black fine particles may be used by low doses.

When the toner according to the invention is used as a binary developer, the toner is mixed with carrier. In this case, the mixing ratio of the toner to the carrier is preferably in a range of from 2 wt % to 10 wt % in toner density.

As the carrier used in the invention, known ones are available. Examples of the carrier include iron powder, ferrite, magnetite, glass beads, and these carriers each subjected to surface treatment with fluorine-based resin, vinyl-based resin or silicon-based resin.

The toner according to the invention may contain a magnetic material. The magnetic material may also play a role of a coloring agent. In the invention, examples of the magnetic material contained in the toner include iron oxides such as magnetite, hematite and ferrite; metals such as iron, cobalt and nickel; alloys between these metals and metals such as aluminum, cobalt, copper, lead, magnesium, tin, zinc, antimony, calcium, manganese, selenium, titanium, tungsten and vanadium; and mixtures of these magnetic materials.

The average particle size of these magnetic substances is set to be not larger than 2 μm, preferably in a range of approximately from 0.1 μm to 0.5 μm. The quantity of the magnetic substances to be contained in the toner is preferably in a range of from 0.1 wt % to 200 wt % relative to the fixing resin.

In addition, the toner according to the invention may be used as magnetic toner.

Known pigments and dyes can be mentioned as coloring agents that can be used in the toner according to the invention. Examples of the pigments include carbon black, aniline black, acetylene black, naphthol yellow, Hansa yellow, rhodamine lake, alizarin lake, red iron oxide, phthalocyanine blue, and indanthrene blue. These pigments are used by adequate doses required for keeping the optical density of a fixed image, and preferably added at the ratio of 0.2 to 15 wt % to the resin.

Further, dyes are used for the similar purpose. Examples of such dyes include azo-based dyes, anthraquinone-based dyes, xanthene-based dyes, and methane-based dyes. These dyes are added at the ratio of 0.2 to 15 wt % to the resin.

To produce toner for electrostatic charge development in the invention, low molecular weight wax, fixing resin, a charge control agent, pigment or dye as a coloring agent, magnetic powder, further other wax or additives in accordance with necessity, and fixing resin in which wax has been dispersed uniformly, are combined, and mixed sufficiently by a mixer such as a Henschel mixer or a super mixer. Such raw materials are then melted and kneaded by a hot-melt kneader such as a heating roll, a kneader or an extruder till they are mixed sufficiently again. After that, the mixture is cooled and solidified. The solid mixture is pulverized and classified to obtain toner whose average particle size is in a range of from 4 μm to 10 μm. Toner having a average particle size of from 4 μm to 10 μm may be obtained by a so-called polymerization process in which coloring agent, charge control agent and wax and the like are dispersed and polymerized upon reaction of resin monomer.

Further, desired additives are mixed to the toner by a mixer such as a Henschel mixer in accordance with necessity so as to adhere to the toner. Thus, it is possible to obtain toner to which the additives have been externally added.

According to the invention, there is provided an image forming method in which an electrostatic charge latent image formed on an electrostatic charge holding member is made visible by use of a binary developer composed of toner and carrier according to the invention, a toner image obtained thus is transferred onto a recording medium, and a residual toner image on the electrostatic charge holding member is cleaned up while the toner image transferred on the recording medium is fixed to obtain a recorded image. Accordingly, in this image forming method, an image showing superior fixing performance particularly at lower temperature than that in the related art in an electrostatic image recording step can be provided. In addition, the obtained image has a feature in strength against rubbing.

In addition, the toner according to the invention is excellent in fluidity, heat resistance, durability and storage stability. The life of developer is hardly reduced due to carrier spent by the toner, and the life of a photosensitive body is hardly reduced due to filming of the photosensitive body with the toner. In addition, it is possible to obtain a stable electrostatic toner image.

The invention will be described below specifically with illustration of its examples and comparative examples.

EXAMPLE 1

A raw material composed of 86 wt % of styrene-acryl-based copolymer resin (made by Sanyo Chemical Industries Ltd., trade name: HIMER SB316, Mw 238,000, Mn 3,500), 1 wt % of chromium containing metal dye (made by Orient Chemical Industries Ltd., trade name: BONTRON S-34), 8 wt % of carbon black (made by Mitsubishi Chemical Corp., trade name: MA-100), and 5 wt % of polyethylene wax (made by Yasuhara Chemical Co., Ltd., trade name: NEO-WAX L, polyethylene-basis molecular weight Mn 380, DSC endothermic peaks at 74.2° C. and 94.3° C.) was prepared.

The raw material was premixed by a super mixer, and hot-melt-kneaded by a biaxial kneader. Then, the raw material was cooled and pulverized. This was classified by a dry air flow classifier so as to obtain particles whose average particle size was 9 μm.

Further, 0.8 wt % of hydrophobic silica (made by Nippon Aerosil Co., Ltd., trade name: AEROSIL R972) was added to the particles, and stirred by a Henschel mixer so as to adhere to the surfaces of the particles. Thus, toner in this example was obtained. Incidentally, the average particle size of the toner at that time was 8.8 μm, and toner not larger than 4 μm was 6.5% by number.

EXAMPLE 2

Toner in this example was obtained in the same manner as that in Example 1, except that 5 wt % of polyethylene wax (made by Yasuhara Chemical Co., Ltd., trade name: NEO-WAX AL, polyethylene-basis molecular weight Mn 430, DSC endothermic peaks at 83.7° C., 98.4° C. and 116.3° C.) was used. Incidentally, the average particle size of the toner at that time was 8.6 μm, and toner not larger than 4 μm was 7.8% by number.

EXAMPLE 3

Toner in this example was obtained in the same manner as that in Example 1, except that 2.5 wt % of polyethylene wax (made by Toyo Petrolight Com., trade name: PW 1000, polyethylene-basis molecular weight Mn 820, DSC endothermic peaks at 110.0° C.) and 2.5 wt % of paraffin wax (made by Nippon Seiro Co., Ltd., trade name: HNP-11, polyethylene-basis molecular weight Mn 440, DSC endothermic peaks at 60.9° C. and 70.6° C.) was used.

Incidentally, the average particle size of the toner at that time was 8.9 μm, and toner not larger than 4 μm was 4.8% by number.

Comparative Example 1

Toner in this comparative example was obtained in the same manner as that in Example 1, except that 5 wt % of polyethylene wax (made by Toyo Petrolight Com., trade name: PW 1000, polyethylene-basis molecular weight Mn 820, DSC endothermic peaks at 110.0° C.) was used.

Incidentally, the average particle size of the toner at that time was 8.7 μm, and toner not larger than 4 μm was 6.9% by number.

Comparative Example 2

Toner in this comparative example was obtained in the same manner as that in Example 1, except that the polyethylene wax was replaced by 5 wt % of wax made by Nippon Seiro Co., Ltd., under trade name of FT 100 (polyethylene-basis molecular weight Mn 660, DSC endothermic peaks at 93.6° C.).

Incidentally, the average particle size of the toner at that time was 8.5 μm, and toner not larger than 4 μm was 6.1% by number.

Comparative Example 3

Toner in this comparative example was obtained in the same manner as that in Example 1, except that the polyethylene wax was replaced by 5 wt % of wax made by Sazole Com., under trade name of SPRAY30 (polyethylene-basis molecular weight Mn 520, DSC endothermic peaks at 91.9° C.) was used.

Incidentally, the average particle size of the toner at that time was 8.8 μm, and toner not larger than 4 μm was 18.3% by number.

Next, fixing performance and storage stability were evaluated on the respective toners in Examples 1 to 3 and Comparative Examples 1 to 3 in the following method.

(1) Non-Offset Temperature Range

In an electrophotographic laser beam printer using an OPC as a photosensitive body, images were formed in the conditions of OPC charge potential of −650 V, residual potential of −50 V, developing bias potential of −400 V, developing-site contrast potential of 350 V, and printing speed of 60 sheets per minute (printing process speed of 26.7 cm/sec).

Developer with toner density of 2.5 wt % was prepared using, as carrier, magnetite carrier (electric resistance of 4.1×108 Ω.cm) having a weight average particle size of 100 μm and coated with conductive agent containing silicon-based resin.

By use of this developer, images were formed by reverse development in a magnetic brush developing process by setting a developing gap (distance between a photosensitive body and a developing roll sleeve) to 0.8 mm, moving the photosensitive body and the developing roll in the same direction, and setting the peripheral speed ratio between the both (developing roll to photosensitive body) to 3.

As for a fixing unit, a core made of aluminum was coated with a tube of fluororesin (tetrafluoroethylene-perfluoroalkylvinylether copolymer: PFA) (so as to have a thickness of 40 μm), and a heater lamp was installed in a center portion so as to form a heat roll. In addition, a silicon rubber layer (7 mm thick) having a rubber hardness of about 30 degrees was provided over a core made of aluminum, and the outermost layer thereof was coated with a PFA tube so as to form a backup roll.

The fixing conditions were set as follows. That is, the process speed was 26.7 cm/sec, the outer diameter of each of the heat roll and the backup roll was 60 mmϕ, the pressing load was 50 kgf, and the width of a contact area (nip) between the heat roll and the backup roll was about 7 mm. In such fixing conditions, the control temperature of the heat roll was varied. Thus, offsets were evaluated from dirt in white portions of fixed images at respective surface temperatures of the heat roll.

Incidentally, a cleaner of a type which could wind Nomex paper impregnated with silicon oil was essentially installed in the heat roll. However, the cleaner was removed when the offsets were evaluated. Then, each image was recorded on cardboard (about 200 μm thick) and thin paper (about 100 μm thick) free from silicon oil. Thus, low-temperature offsets were evaluated from the former, and high-temperature offsets were evaluated from the latter.

(2) Fixing Strength

The surface temperature of the heat roll of the fixing unit was set to 175° C., and a solid black image one inch square and a 1-on-4-off laser line image were recorded on the cardboard (about 200 μm thick). A tape peel test and a rubbing test were performed on each image so as to evaluate the fixing strength of the image.

In the tape peel test, Scotch mending tape 810 was attached onto the solid black image, and image density was measure by a reflection densitometer (RD-914 made by Gretag Macbeth Ltd.) before and after the tape was peeled off. Thus, the tape peel strength was obtained by the following equation.

$$\text{tape peel strength } (\%) = (A/B) \times 100 \quad (1)$$

where A designates the reflection density of the solid black image after the tape was peeled off, and B designates the reflection density of the solid black image before the tape was peeled off.

In the rubbing test, the line image was rubbed with Whatman filter paper 44 at a load of 200 gf, and the condition of dirt on the filter paper was evaluated by a whiteness meter. Reflectance of the light between the dirt filter paper and virginal filter paper was obtained in Hunter's value (%), which was adopted as rubbing strength (%).

(3) Storage Stability

The toner was put onto a metallic petri dish, and left at 50° C. for 24 hours in a desiccator whose humidity was controlled to be 91% RH by a humidity control agent. Thus, the degree of aggregation of the toner was evaluated by eye observation.

(4) Developer Life

In the laser beam printer, a cleaner of a type which could wind Nomex paper impregnated with silicon oil was installed in the heat roll. The surface temperature of the heat roll was set to 180° C., and a test for continuously printing 200,000 pages was carried out. A small amount of developer was sampled from a developing unit, and the quantity of carrier spent by the toner was measured.

Carbon ratios (%) per unit weight were measured on spent carrier from which toner was removed and unused carrier by use of a carbon analyzer for carbon in metals (EMIA-110 made by Horiba Ltd.). The quantity of carrier spent was evaluated as a difference between the carbon ratios.

The evaluation results of toners along the respective items are shown in Table 1.

TABLE 1

| | | Property of Wax added to toner | | | Fixing preformance and storage stability of toner | | | | | |
|---|---|---|---|---|---|---|---|---|---|---|
| | | Kind | PE-basis molecular weight (Mn) | Endothermic perks (° C.) in DEC | Toner average particle size (μm) | % by number of not larger than 4 μm | Non-offset temperature range (° C.) | Tape peel strength (%) | Rubbing strength (%) | Carrier spent (wt %) |
| Example | 1 | PE wax (NEOWAX L) | 380 | 74.2 94.3(max) | 8.8 | 6.5 | 165 → 220 | 86 | 78 | 0.09 |
| | 2 | PE wax (NEOWAX AL) | 430 | 83.7 98.4(Max) 116.3 | 8.6 | 7.8 | 165 → 220 | 84 | 76 | 0.08 |
| | 3 | PE wax (POLYWAX 1000) | 820 | 110.0 | 8.9 | 4.8 | 165 → 220 | 82 | 80 | 0.10 |
| | | P wax (HNP-11) | 440 | 60.9 70.6(Max) | | | | | | |
| Comp. | 1 | PE wax (POLYWAX 1000) | 820 | 110.0 | 8.7 | 6.9 | 175 → 220 | 55 | 57 | 0.07 |
| | 2 | FT wax (FT100) | 660 | 93.6 | 8.5 | 6.1 | 185 → 220 | 63 | 65 | 0.08 |
| | 3 | FT wax (SPRAY30) | 520 | 91.9 | 8.8 | 18.3 | 175 → 220 | 75 | 73 | 0.35 |

PE: polyethylene
P: paraffin
FT: Fischer-Tropsch

As is understood from the evaluation results in Table 1, any toner according to the invention is difficult to produce an offset in a range from low temperature to high temperature. The toner has a non-offset temperature range wide so that dirt on images after fixing is difficult to be produced even if the temperature of the fixing unit varies to some extent.

In addition, as for the fixing strength at the fixing temperature 175° C., the tape peel strength was 80% or higher, and the rubbing strength was 75% or higher. Thus, very high fixing strength was obtained. On the other hand, each of the toners in Comparative Examples 1 and 2 had a narrow non-offset range, and could not obtain sufficient fixing strength.

In addition, when each toner was applied to the laser beam printer so as to carry out continuous printing, excellent fluidity could be obtained in Examples 1 to 3 and Comparative Examples 1 and 2. Even if300, 000 pages were printed continuously repeatedly, the life of developer was not reduced due to carrier spent by the toner, and the life of the photosensitive body was not reduced due to filming of the photosensitive body with the toner. Thus, stable images could be obtained.

However, in Comparative Example 3, the fluidity was inferior, so that after continuous printing of the 200,000 pages, the life of developer was reduced due to carrier spent, and the life of the photosensitive body was reduced due to filming of the photosensitive body with the toner. Thus, images deteriorated.

In addition, storage stability of toner was confirmed in Examples 1 to 3 and Comparative Examples 1 to 3, but toner aggregation was not confirmed in any toner.

By use of electrostatic charge developing toner according to the invention, there is an effect as follows. That is, it is difficult to produce an offset in a range from low temperature to high temperature. Because the non-offset temperature range is wide, dirt is difficult to be produced on an image after fixing even if the temperature of a fixing unit varies to some extent.

Further, electrostatic charge developing toner according to the invention can obtain excellent effects in which fluidity, heat resistance, durability and storage stability of the toner are excellent; the life of developer is hardly reduced due to carrier spent by the toner; and the life of a photosensitive body is hardly reduced due to filming of the photosensitive body with the toner.

In addition, in an image forming method using the toner, it is possible to obtain an image based on a stable electrostatic toner image.

What is claimed is:

1. An electrostatic charge developing toner comprising:

a plurality of toner particles comprising:

a fixing resin;

a coloring agent; and a wax having a number average molecular weight of not higher than 600, wherein a volume average particle size of the toner is in a range of from 5 μm to 10 μm, and the total number of toner particles having a particle size of not larger than 4 μm is 10% or less.

2. The electrostatic charge developing toner according to claim 1, wherein a maximum value of endothermic peaks on a heat absorption curve measured by a differential scanning calorimeter (DSC) is in a range of from 35° C. to 120° C.

3. The electrostatic charge developing toner according to claim 1, wherein said total number of toner particles having a particle size of not larger than 4 μm is 8% or less.

4. The electrostatic charge developing toner according to claim 1, wherein said wax comprises one of a polyethylene wax, a paraffin wax, and a Fischer-Tropsch wax.

5. The electrostatic charge developing toner according to claim 1, wherein a ratio of said wax to said fixing resin is in a range of 0.1 wt % to 10 wt %.

6. The electrostatic charge developing toner according to claim 1, wherein said fixing resin comprises one of a styrene-based copolymer and a polyester resin.

7. The electrostatic charge developing toner according to claim 1, further comprising:

a charge control agent for controlling a charge quantity of said toner.

8. The electrostatic charge developing toner according to claim 7, wherein a ratio of said charge control agent to said fixing resin is in a range of 0.1 wt % to 10 wt %.

9. The electrostatic charge developing toner according to claim 1, further comprising at least one of silica impalpable powder, a lubricant powder, a powder abrasive, a fluidity enhancer, an anti-aggregation agent, an electric conductivity enhancer and a developing property improver.

10. The electrostatic charge developing toner according to claim 1, further comprising:

a carrier in a range of 2 wt % to 10 wt % of said toner.

11. The electrostatic charge developing toner according to claim 10, wherein said carrier comprises one of iron powder, ferrite, magnetite, and glass beads.

12. The electrostatic charge developing toner according to claim 1, further comprising:

a magnetic material having an average particle size in a range of 0.1 μm to 0.5 μm, and a ratio of said magnetic material to said fixing resin is in a range of 0.1 wt % to 200 wt %.

13. The electrostatic charge developing toner according to claim 1, wherein a ratio of said coloring agent to said fixing resin is in a range of 0.2 wt % to 15 wt %.

14. An image forming method comprising:

developing an electrostatic charge latent image formed on an electrostatic charge holding member by use of a binary developer comprising toner and carrier;

transferring the developed toner image onto a recording medium;

cleaning up a residual toner image on the electrostatic charge holding member; and fixing the toner image transferred on the recording medium to obtain a recorded image, wherein said toner comprises an electrostatic charge developing toner comprising:

a plurality of toner particles comprising:

fixing resin;

a coloring agent; and a wax having an average molecular weight of not higher than 600, and wherein a volume average particle size of the toner is in a range of from 5 μm to 10 μm, and the total number of toner particles having a particle size of not larger than 4 μm is 10% or less.

15. The image forming method according to claim 14, wherein a maximum value of endothermic peaks on a heat absorption curve measured by a differential scanning calorimeter (DSC) is in a range of from 35° C. to 120° C.

16. A method of manufacturing an electrostatic charge developing toner, comprising:

forming a mixture of a fixing resin, a coloring agent, and a wax having a number average molecular weight of not higher than 600;

melting and kneading said mixture;

cooling and solidifying said mixture; and pulverizing said mixture to form a plurality of toner particles, said plurality of toner particles being classified such that a volume average particle size is in a range of from 5 μm to 10 μm, and the total number of toner particles having a particle size of not larger than 4 μm is 10% or less.

17. The method of manufacturing an electrostatic charge developing toner according to claim 16, wherein said total number of toner particles having a particle size of not larger than 4 μm is 8% or less.

18. The method of manufacturing an electrostatic charge developing toner according to claim 16, wherein a maximum value of endothermic peaks on a heat absorption curve measured by a differential scanning calorimeter (DSC) is in a range of 35° C. to 120° C.

* * * * *